United States Patent [19]

Holper et al.

[11] 4,094,256

[45] June 13, 1978

[54] WORK TABLE HAVING LINES EMBODIED THEREIN

[75] Inventors: Manfred Hölper; Günter Schertel; Egon Kösters, all of Pohlheim, Germany

[73] Assignee: VOKO Franz Vogt & Co., Pohlheim, Germany

[21] Appl. No.: 693,173

[22] Filed: Jun. 7, 1976

[30] Foreign Application Priority Data

Jun. 7, 1975 Germany ..... 2525498

[51] Int. Cl.[2] ..... A47B 35/00; A47B 77/08

[52] U.S. Cl. ..... 108/50; 108/33; 312/194; 312/223

[58] Field of Search ..... 108/50, 23, 150, 33; 312/223, 195, 196, 194, 236, 239; 62/258; 174/48

[56] References Cited

U.S. PATENT DOCUMENTS

| | | | |
|---|---|---|---|
| 1,727,032 | 9/1929 | Guignon | 108/50 X |
| 1,905,402 | 4/1933 | Sink | 174/48 X |
| 1,978,572 | 10/1934 | Earl | 108/50 X |
| 2,306,209 | 12/1942 | Elofson et al. | 312/196 X |
| 2,678,489 | 5/1954 | Ratzlaff et al. | 312/196 X |
| 2,863,709 | 12/1958 | Hausman | 312/223 X |
| 3,000,682 | 9/1961 | Loew et al. | 312/194 |
| 3,192,306 | 6/1965 | Skonnord | 312/236 X |
| 3,327,092 | 1/1967 | Wilson | 312/236 X |
| 3,462,649 | 8/1969 | Stitch | 312/223 X |
| 3,497,281 | 2/1970 | Wilde | 312/223 |
| 3,628,829 | 12/1971 | Hellig | 297/180 |
| 3,635,174 | 1/1972 | Ball et al. | 108/50 X |
| 3,664,063 | 5/1972 | Ware | 108/23 X |
| 3,770,334 | 11/1973 | Weber | 312/194 X |
| 3,883,202 | 5/1975 | Konig | 312/223 |
| 3,948,246 | 4/1976 | Jenkins | 297/180 X |

FOREIGN PATENT DOCUMENTS

| | | | |
|---|---|---|---|
| 2,160,221 | 6/1973 | Germany | 312/192 |
| 2,363,698 | 6/1975 | Germany | 312/194 R |
| 555,072 | 1/1957 | Italy | 312/194 |

*Primary Examiner*—James T. McCall

*Attorney, Agent, or Firm*—Blanchard, Flynn, Thiel, Boutell & Tanis

[57] ABSTRACT

A work table having side supports in which are laid electrical wires or other types of lines to provide convenient access for apparatus used in conjunction with the work table. The side supports have at their upper area channels which extend parallel to the work surface. The channels have openings therein for guiding the wire or other types of wires therethrough to the work surface. A cavity is also provided in the side supports for housing the wires or other types of lines.

10 Claims, 9 Drawing Figures

WORK TABLE HAVING LINES EMBODIED THEREIN

FIELD OF THE INVENTION

The invention relates to a work table with side supports, in which work table wires are laid to connect apparatus.

BACKGROUND OF THE INVENTION

The number of apparatus which are needed at one work place increases constantly so that both the arrangement of the apparatus on or rather in the work table, and also storage of the supply wires and in particular their placement in the table creates considerable difficulties, if at the same time the remaining functions of the respective work table are not to be influenced. Thus the arrangement of the supply wires, for example, in a desk must take place in such a manner that the accessibility of the work surface and the surface which is provided for receiving files, card files and the like is not influenced.

From German OS No. 1 814 784 a work table is known, in which electric wires are mostly guided in cavities of structural elements which are part of the desk to a connecting set arranged on the desk. The electric wires are stored either in the cavity of the frame of the table or, however, in a cavity existing in the desk top. In case that this cavity should be very large, it is suggested to define same from the remaining cavity by separating bars. The wires which are arranged in the cavities of the table are guided to a centrally arranged outlet which is arranged either below or in a recess of the table top. From this outlet the electric supply wires are guided through the table top to the individual electric apparatus which are on the table. A disadvantage of this known arrangement of the electric supply wires in the work table is that the wires, depending on the spacing of the electric apparatus from the outlet, must be laid a longer or shorter distance on the table top, which interferes with the use of the desk. Furthermore laying of cable into the existing angular and narrow cavities of the space or the desk top is difficult and time-consuming. In particular it is connected with a great amount of work to renew existing wires later on or to lay new wires. This is also true for the subsequent installation of additional outlets or for a moving of existing ones.

The basic purpose of the invention is to construct a work table of the abovementioned type in such a manner that the wires and apparatus can be compactly stored on or in same without affecting the remaining uses of the work table including the mechanical stability thereof.

This purpose is attained inventively by the side supports of the work table having at least, in their upper area, channels which extend parallel to the work surface and have openings to guide the supply wires therethrough to the work surface, and by providing in the side supports a cavity for feeding in the wires, which cavity extends over the height of the side supports.

Connecting means for the wires and apparatus, for example outlets, plug units, are preferably arranged in the channels of the side supports. These connecting means are accessible, depending on the construction of the table, from above, below or from the sides.

According to a further exemplary embodiment of the invention, a recess is constructed in the surface of the channel which can be closed off by a lid and into which are mounted connecting means for apparatus, lamps, telephones and outlets. The side supports are preferably constructed in T-, double-T or L-shape. In a base frame of such a construction the entire upper crossbar is advantageously constructed as a channel. In case that the connecting means are arranged inside of the channel, the supply wires can be guided from the work table top through a slot which extends in the sidewall of the channel to the connecting means.

By using hollow side supports, the supply wires can be guided invisibly from floor channels to the channel. The advantage of the inventive arrangement consists in accessibility of the wires existing practically at any place of the desk which causes the length of the wires extending on the table and leading to the apparatus to be at a minimum. Furthermore, a simple laying of the wires into the desk exists and on the other hand the wires can be supplemented or exchanged also later on in a simple manner. This is true for both electric wires and also for lines for the supply and distribution of different media.

In particular the channels can serve as air distributors for air conditioning. For this purpose the lines are connected to supply air or discharge air channels which are laid in the floor. The supplied air can be removed from the air distributor at any desired point through air outlet openings. Furthermore a sucking off of the room air through the air distributor is also possible.

BRIEF DESCRIPTION OF THE DRAWINGS

Several exemplary embodiments of the invention will be described more in detail hereinafter in connection with the drawings, in which.

DETAILED DESCRIPTION

Figure 1:
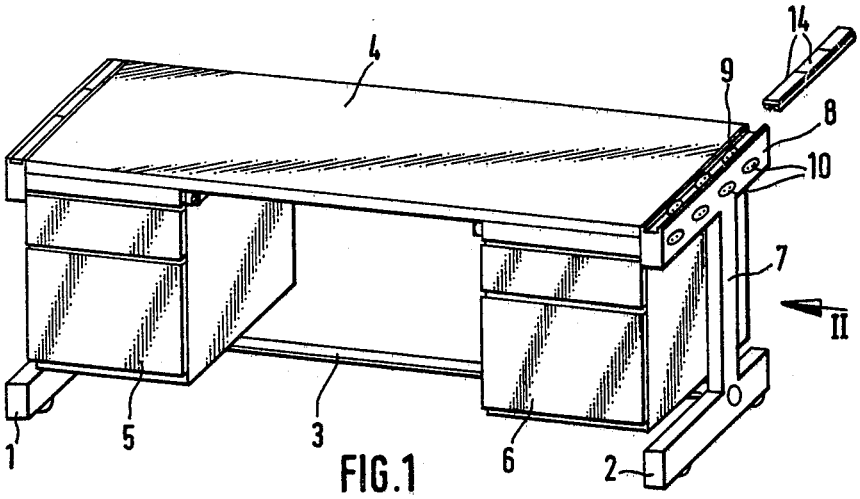
FIG. 1 is a perspective view of a work table of the invention.
Figure 2:
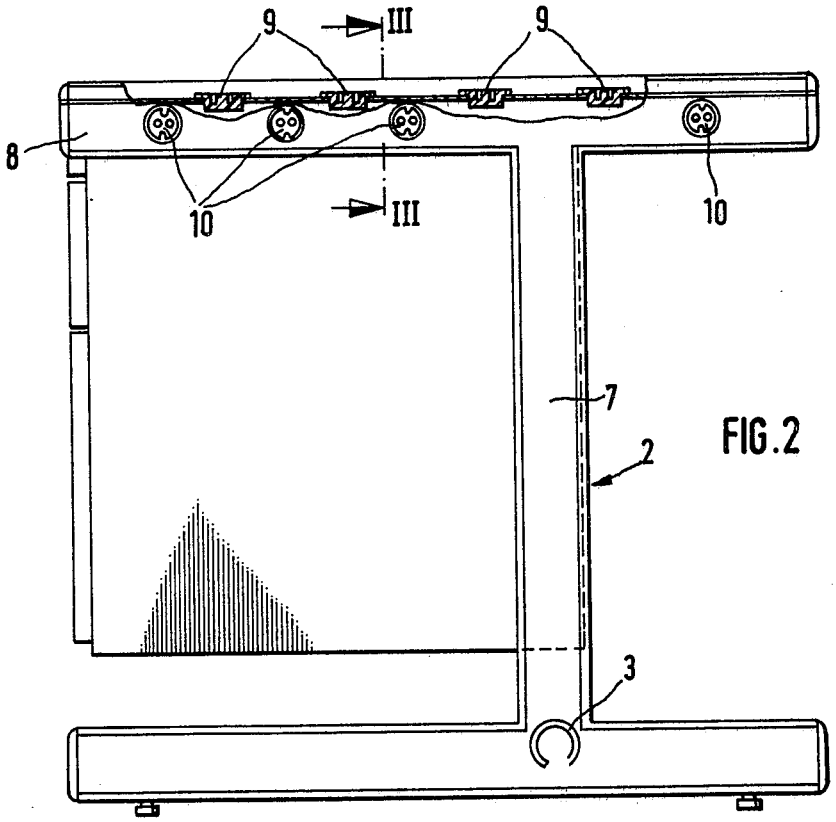
FIG. 2 is a side view of the desk viewed in direction of the arrow II, in FIG. 1.
Figure 3:
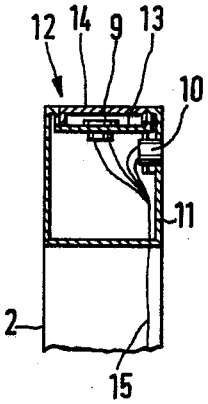
FIG. 3 is a cross-sectional view along the line III—III of FIG. 2.

The work table which is shown in FIGS. 1 to 3 consists of two H-shaped constructed side supports 1, 2, which are connected at the bottom thereof by a base pipe 3. On top, the side supports are connected through a frame which supports the table top 4. Two lower cabinets 5, 6 are suspended below the table top.

The double-T-shaped constructed side support is constructed as a hollow member so that the wires which are guided through the base pipe 3 into the side support are guided through the bar 7 into the upper part on cross piece 8 of the support. This upper part 8 of the support is constructed as a cable channel in which outlets 9, 10 are arranged.

The side supports 1, 2 consists, as can be recognized from FIG. 3, of a hollow profile the width of which is chosen in such a manner that sufficient space exists for arranging the outlets. The outlets which face to the side are secured directly on the outside wall 11 of the side support. The outlets 9 are secured in a recess 13 which is arranged in the front surface 12 of the cable channel, which recess 13 can be closed off by a lid 14.

The cables 15 which lead to the outlets 9, 10 are, as already discussed, laid in the bar 7 and in the base pipe 3. The base pipe 3 is open downwardly so that the lines which are arranged in floor channels can be introduced at any desired point into the desk.

Figure 4:
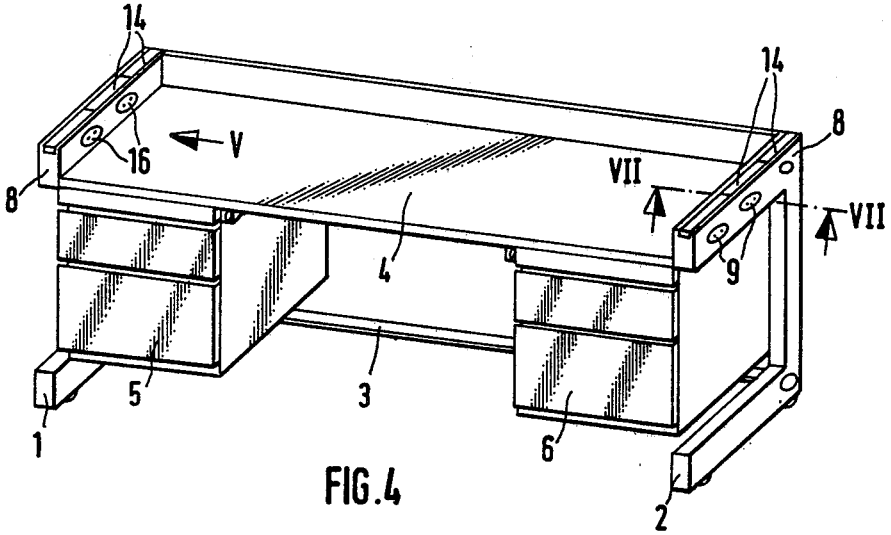
FIG. 4 illustrates a further exemplary embodiment according to the invention.
Figure 5:
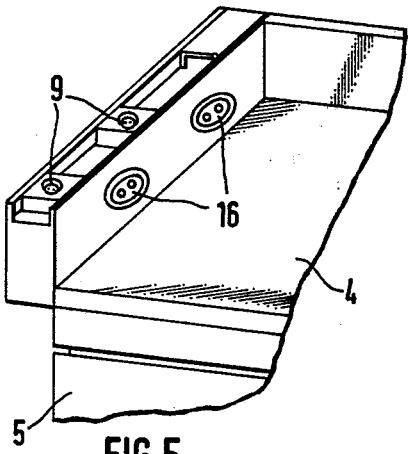
FIG. 5 illustrates in an enlarged scale a corner of the desk shown in FIG. 4.
Figure 7:
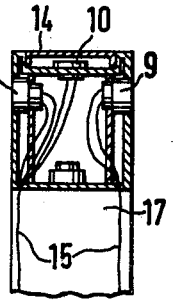
FIG. 7 is a cross-sectional view along the line VII—VII of FIG. 6.
Figure 6:
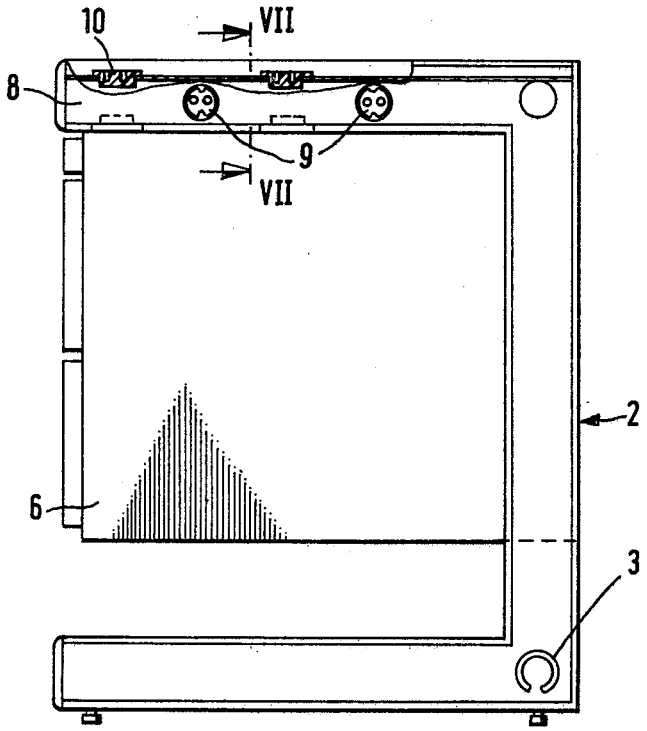
FIG. 6 is a side view of a further exemplary embodiment according to the invention.

In the exemplary embodiment illustrated in FIGS. 4 and 5, the same parts are identified with the same reference numerals. The difference between the exemplary embodiment according to FIGS. 4 and 5 and the one according to FIG. 1 consists substantially in the side supports being constructed U-shaped and the table top 4 not lying in one common plane with the lid 14 of the cable channel 8. Through the lower-lying table top 4 it is possible to provide in the cable channel 8 also outlets 16 which are directed toward the table top. A side view and a cross-sectional view of the exemplary embodiment which is illustrated in FIGS. 4 and 5 is shown in FIGS. 6 and 7.

Figure 8:
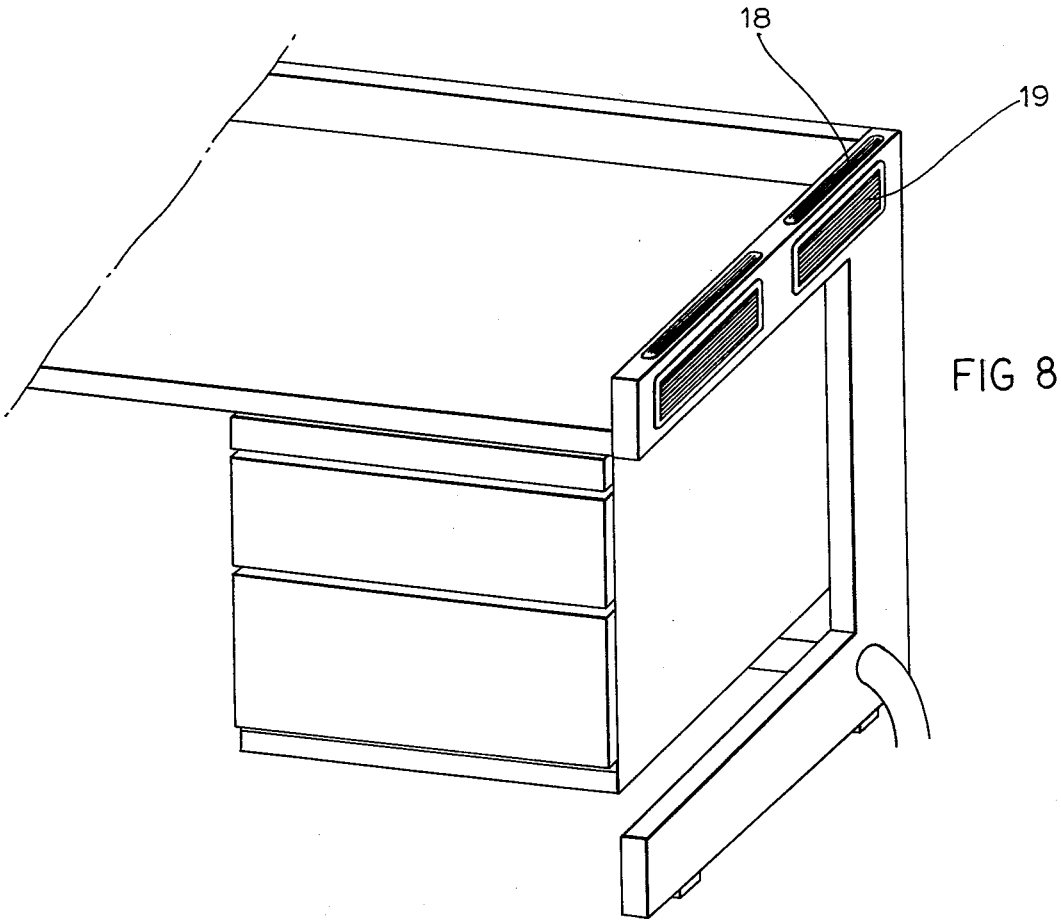
FIG. 8 is a side view of a further exemplary embodiment according to the invention.
Figure 9:
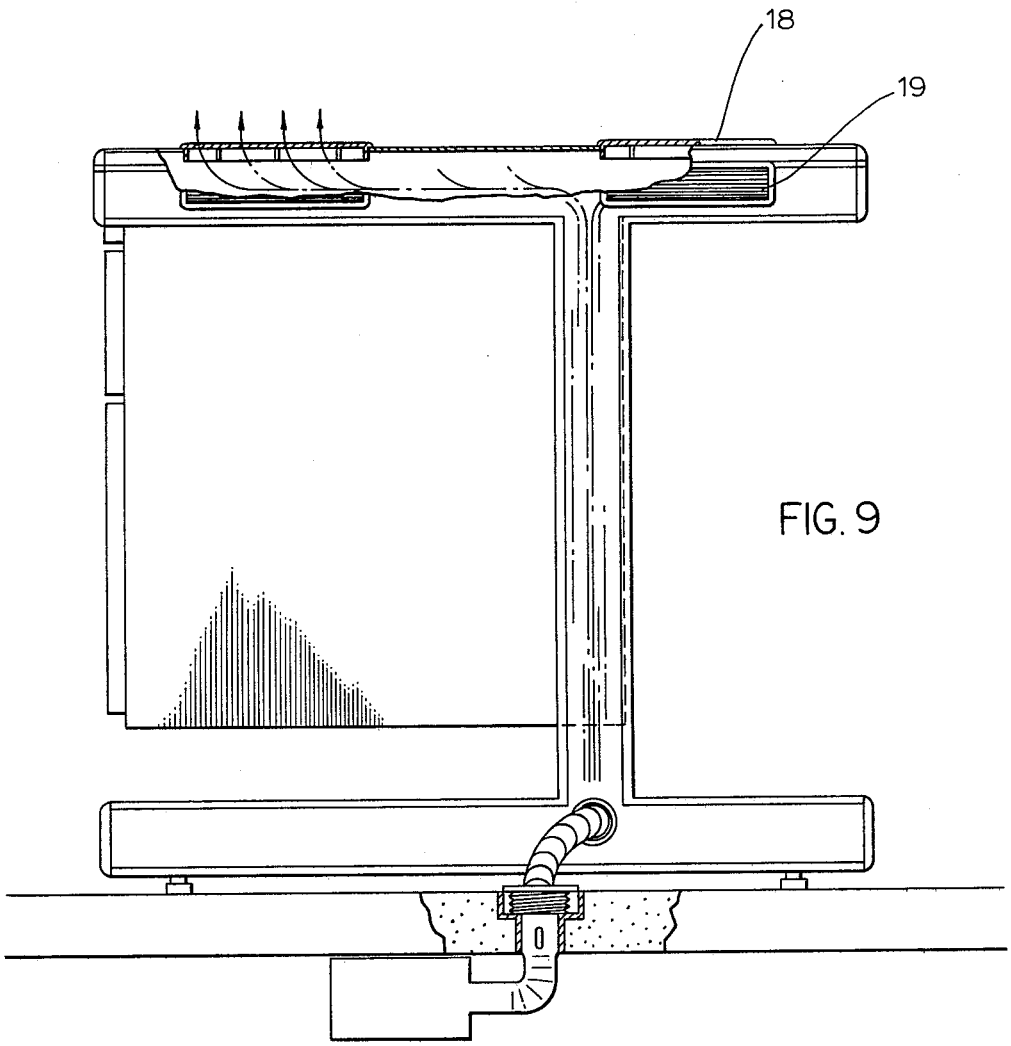
FIG. 9 is a fragment of a perspective view of the embodiment of FIG. 8.

The channels in the side supports can also serve as air distributors for air conditioning. For this purpose, the channels 8 and the hollow interior of bar 7 (FIGS. 8 and 9) are connected to supply air or discharge air channels which are laid in the floor. The supplied air can be removed from the air distributor at any desired point through air outlet openings 18 and 19. In addition, a removal of room air through the air distributor is also possible through the same or similar outlets.

The embodiments of the invention in which an exclusive property or privilege is claimed are defined as follows:

1. A work table having a work surface thereon, comprising:

a pair of horizontally spaced and hollow side supports each having adjacent their upper ends a cross piece, said cross pieces being parallel with each other and supporting said work surface adjacent the lateral edges thereof;

a channel in each of said cross pieces which extend parallel with said lateral edges of said work surface, at least one of said channels having at least one opening therein for guiding electrical wires therethrough from the interior of said cross piece to the exterior thereof;

a cavity in each of said side supports for housing said electrical wires, said cavity extending along the height thereof and communicating with at least one of said channels in said cross pieces; and electrical socket means connected in electrical circuit with said electrical wires and mounted in said opening in at least one of said channels in at least one of said cross pieces.

2. A work table according to claim 1, wherein said electrical socket means is also mounted on at least one laterally facing side of said one cross piece and faces at least one of toward and away from said work surface.

3. A work table according to claim 1, wherein said channel in said one cross piece has recess means with a floor therein;

wherein said openings are in said floor of said recess means; and wherein said electrical socket means is mounted in said openings.

4. A work table according to claim 1, wherein said side supports each have a double T-shape.

5. A work table according to claim 1, wherein said side supports each have a double L-shape.

6. A work table according to claim 1, wherein said side supports each have a T-shape.

7. A work table according to claim 1, wherein said channels in said cross pieces open upwardly;

wherein said electrical socket means include a plurality of electrical sockets each mounted in said upwardly opening channel; and including removable lid means for covering said channel and said electrical sockets mounted therein.

8. A work table having a work surface thereon, comprising:

a pair of hollow side supports each having adjacent their upper ends a cross piece with a channel therein, said cross pieces extending along the lateral edges of and are parallel with said work surface and support said work surface, said channels being enclosed on all sides thereof to define an air distributor for guiding movement of air therethrough to areas adjacent said work surface;

enclosed cavity means in each of said side supports and extending along the height thereof and communicating with said channels; and ventilating outlets mounted on at least one of said side supports and communicating with said channels therein whereby air movement in and around said work surface is enhanced by air flow through said ventilating outlets.

9. A work table according to claim 8, wherein said ventilating outlets are directed to the side of said work surface.

10. A work table according to claim 8, wherein said ventilating outlets are directed upwardly from said cross pieces.

* * * * *